US006197230B1

(12) United States Patent
Pierre et al.

(10) Patent No.: US 6,197,230 B1
(45) Date of Patent: Mar. 6, 2001

(54) PROCESS FOR THE PREPARATION OF A MIXTURE OF CELLULOSIC FIBERS AND MICROFIBERS

(75) Inventors: Michel Pierre, Beauvais; Nathalie Brunet, Cabestany; Patrick Navard, Biot, all of (FR)

(73) Assignee: Acordis Fibres (Holdings) Limited, London (GB)

( * ) Notice: Subject to any disclaimer, the term of this patent is extended or adjusted under 35 U.S.C. 154(b) by 0 days.

(21) Appl. No.: 08/981,025

(22) PCT Filed: Oct. 10, 1999

(86) PCT No.: PCT/FR96/00990

§ 371 Date: Aug. 12, 1998

§ 102(e) Date: Aug. 12, 1998

(87) PCT Pub. No.: WO97/01660

PCT Pub. Date: Jan. 16, 1997

(Under 37 CFR 1.47)

(30) Foreign Application Priority Data

Jun. 26, 1995 (FR) ..... 95 07641

(51) Int. Cl.[7] ..... D01F 2/00
(52) U.S. Cl. ..... 264/6; 264/11; 264/12
(58) Field of Search ..... 264/6, 11, 12

(56) References Cited

U.S. PATENT DOCUMENTS

| | | |
|---|---|---|
| 2,988,782 | 6/1961 | Parrish et al. . |
| 3,114,747 | 12/1963 | Campbell . |
| 3,785,918 | 1/1974 | Kawai et al. . |

*Primary Examiner*—Mary Lynn Theisen
(74) *Attorney, Agent, or Firm*—Nixon & Vanderhye P.C.

(57) ABSTRACT

The present invention relates to a process for the preparation of a mixture of cellulosic fibers and microfibers. Said process comprises:

the preparation of a cellulosic solution (C);

the extrusion of said solution (C) through the hole or holes of a die (1);

the disintegration of said solution (C) when it comes out of said hole or holes by projecting a liquid or gas fluid (F) in a direction making an angle lower than or equal to 75 degrees with the axis of said die (1); said fluid (F) being neutral or appropriate to regenerate or precipitate, only partially, the cellulose;

the reception in a cellulose regeneration or precipitation bath, of the dispersion generated at the disintegration step;

the recovery of the mixture of fibers and microfibers, more or less bonded, obtained in said bath. Said process provides for the preparation of mixtures rich in microfibers (with a fineness lower than 1 dtex, particularly between 0.5 and 0.3 dtex). It also provides for the continuous preparation of nonwoven materials.

14 Claims, 2 Drawing Sheets

PROCESS FOR THE PREPARATION OF A MIXTURE OF CELLULOSIC FIBERS AND MICROFIBERS

The present invention relates to a process for the preparation of mixtures of cellulosic fibers and microfibers.

In the present text and the claims attached hereto, cellulosic microfibers are understood to mean fibers based on cellulose or alloys of cellulose, whose fineness is less than 1 dtex (which generally corresponds to an equivalent diameter of said fibers smaller than 10 $\mu$m).

The process of the invention is based on the technique of disintegrating a spun solution by a jet of fluid. Similar or like techniques have been carried out in the prior art.

They have been more widely developed within the framework of the preparation of synthetic microfibers. For example, Application FR-A-2 331 632 describes the manufacture of fibrils or microfibers of polypropylene.

In the domain of cellulosic fibers, a process based on said technique of disintegrating is proposed in U.S. Pat. No. 3,114,747. Said process, to Applicants' knowledge, has never been developed and does not allow preparation of microfibers within the meaning of the invention. It consists in coagulating droplets of viscose in the stream of a liquid regenerating agent; said viscose being introduced, through orifices, in said stream at an angle of 90 degrees. In said process, a veritable shear of the extruded viscose is employed. In a first analysis, it may be considered that the process of the invention constitutes an improvement to said process according to U.S. Pat. No. 3,114,747, improvement with a view to obtaining finer fibers.

Furthermore, U.S. Pat. No. 3,785,918 describes a process, based on a different technique, which does allow the preparation of cellulosic microfibers. This process is not strictly speaking carried out with a die. According to this process, the regenerating liquid is injected in a first tube while the viscose flows in a second tube, coaxial to the first and having a larger diameter than that of the first tube. Said viscose is sheared by said liquid, from the inside.

The process of rupturing cellulosic solutions, according to the invention, makes it possible to obtain mixtures of cellulosic fibers which contain cellulosic microfibers and which are therefore very hydrophilic. It is also interesting in that it allows the continuous preparation of non-woven materials.

Said process of the invention, for the preparation of mixtures of cellulosic fibers and microfibers, comprises:

- the preparation of a cellulosic solution;
- the extrusion (or spinning) of said solution through the hole(s) of a die;
- the disintegration of said solution when it comes out of said hole(s) by projecting a liquid or gaseous fluid in a direction making an angle less than or equal to 75 degrees with the axis of said die; said fluid being neutral or adapted to regenerate or precipitate, only partially, the cellulose;
- the reception in a cellulose regeneration or precipitation bath, of the dispersion generated at the disintegration step;
- the recovery of the mixture of fibers and microfibers, more or less bonded, obtained in said bath.

In characteristic manner, according to the present invention, an extruded (spun) cellulosic solution is broken up and the particles of solution resulting from said break-up are drawn with a fluid, which is neutral or adapted only to regenerate or precipitate said particles partially. According to the invention it is not suitable to coagulate said particles at the disintegration step (even less to block the hole(s) of the die) by using a fluid capable of regenerating or precipitating said solution instantaneously. Said particles must be previously drawn. This is why the fluid used is a neutral fluid or one only adapted to regenerate or precipitate said particles partially. Said fluid is chosen (nature) for and/or carried out under conditions (temperature, concentration) such that, even if it is capable of regenerating or precipitating said particles, it can only do so partially.

Furthermore, drawing is possible, in any case optimalized, insofar as said fluid is not responsible for a real shear of the extruded solution. It is projected at an angle much smaller than 90 degrees, and even at a virtually zero angle.

According to the invention, the disintegration of an extruded solution, on leaving a die, is therefore effected under very particular conditions.

To supply the die, at whose outlet the disintegration as described above is effected, any cellulosic solution capable of being extruded (and from which the cellulose can be recovered by regeneration or precipitation) is suitable. Within the scope of the invention, the following are recommended:

- solutions of cellulose,
- solutions of cellulosic derivatives,
- solutions of cellulose alloy or of mixture based on cellulose,
- solutions of alloy of cellulosic derivatives or of mixture based on cellulosic derivatives.

According to the invention, mixtures of cellulosic fibers and microfibers may therefore be prepared from solutions of the material constituting them (solutions of cellulose or of cellulose alloy, called true solutions from which the cellulose or a cellulose alloy will then be precipitated) or from solutions of precursors of said material (solutions of cellulosic derivatives or of alloys of cellulosic derivatives; said cellulosic derivatives then having to be regenerated into cellulose).

The nature of cellulosic solutions which may be extruded and disintegrated when drawn according to the invention are specified hereinafter:

It may therefore be question of true solutions of cellulose and in particular of solutions of the type as used industrially at the present time, for the production of cellulosic fibers by simple spinning: solutions of cellulose in N-methyl N-oxide morpholine (MMNO). Such solutions contain, in practice, from 3 to 12% by weight of cellulose and are solid at temperatures lower than 80° C. With such solutions, the process of the invention must therefore be carried out at temperatures higher than 80° C. Only said solvent MMNO is used industrially at the present time, but other solvents of the cellulose in fact exist, described in the literature and in particular in "Cellulose Chemistry and its applications", Chapter 7, p. 181–200, edited by T. P. Nevell and S. Haig Zeronian (Ellis Horwood Limited—John Wiley & Sons), among which may be cited: pyridine, dimethylsulfoxide (DMSO) taken alone or mixed with formaldehyde; dimethylformamide (DMF) taken alone or mixed with nitrogen oxides (ex. $N_2O_4$/DMF); methylamine, hydrazine . . . as well as inorganic solvents such as lithium, zinc chlorides; calcium trithiocyanate; sulfuric, phosphoric, trifluoroacetic acids; bases such as sodium, lithium, copper hydroxides and in particular cuprammonium liquor or cupriethylenediamine hydroxide, used in the past for manufacturing "copper rayon" . . . Solutions of cellulose based on said solvents may be extruded (spun) and disintegrated when drawn in accordance with the process of the invention, to generate cellulosic fibers and microfibers.

It may also be question of true solutions of alloy of cellulose, i.e. a mixture of cellulose and of another material dissolved in a suitable solvent. Such alloys have been described in the literature and in particular in U.S. Pat. Nos. 4,041,121, 4,144,079, 4,352,770 and 4,302,252, in Polymer, 1991, Volume 32, No. 6, p. 1010–1011 and Macromolecules, 1992, 25, p. 589–592. The following may for example be extruded and disintegrated with drawing in accordance with the invention: a cellulose-polystyrene mixture in carbon sulfide, a cellulose-polyvinylalcohol mixture in dimethylsulfoxide (DMSO) . . .

It may also be question of solutions of cellulosic derivatives. According to this variant, the cellulose has been transformed, upstream, into a soluble derivative which, according to the invention, is extruded, disintegrated and re-transformed into cellulose, so-called regenerated into cellulose. Viscose constitutes an example of such solutions of cellulosic derivatives. It is question of a xanthate of cellulose in solution in sodium hydroxide. It is obtained in conventional manner by preparation, from cellulose (CelOH), of alkali cellulose (CelONa) then by action of carbon sulfide ($CS_2$) on said alkali cellulose (CelONa). Said viscose—cellulose xanthate in sodium hydroxide—may therefore be extruded, disintegrated when drawn and possibly regenerated only partially into cellulose under the action of an adequate disintegrating fluid (active by its acid character and/or its temperature).

Finally, it may be question of solutions of alloy of cellulosic derivatives, i.e. of a mixture of cellulosic derivative-other material dissolved in a suitable solvent; said cellulosic derivative being capable, after regeneration, of being re-transformed into cellulose. Such solutions may in particular consist in aqueous solutions of viscose and of polyvinylpyrrolidone (PVP) as described in U.S. Pat. Nos. 3,377,412 and 4,136,697.

The process of the invention is advantageously carried out with a solution of cellulose in N-methyl N-oxide morpholine (MMNO) or with viscose.

Extrusion of the above solutions—true solutions of cellulose or of cellulose alloy; solutions of cellulosic derivatives or of alloy of cellulosic derivatives—is effected through a die, possibly heated. Said die may conventionally consist in a nozzle having one hole or in a head comprising a plurality of holes. The extrusion (one may also speak of spinning) hole or holes advantageously present an equivalent diameter included between 100 and 1000 $\mu$m. Generally, the process of the invention is carried out with a die presenting at least one hole with a diameter of about 500 $\mu$m.

The extruded or spun solution is disintegrated on leaving the die under the conditions specified hereinabove and recalled hereinafter, by a fluid:

liquid or gaseous, neutral or only partially regenerating or precipitating the cellulose;

projected at an angle less than 75 degrees.

Said conditions ensure a drawing of the disintegrated particles and therefore ensure the presence of microfibers within the mixture of generated fibers.

The fluid employed may be liquid or gaseous.

It is advantageously gaseous.

It may be question of an aqueous solution, "neutral" or slightly acid, projected at ambient temperature or at a temperature higher than ambient temperature.

It may be question of a gas such as air or nitrogen, projected at ambient temperature or at a temperature higher than ambient temperature.

Said fluid—liquid or gaseous—is projected at an angle smaller than or equal to 75 degrees. As indicated above, it is not aimed, with such a fluid, at shearing the extruded solution but at disintegrating it into particles and at drawing said particles. In order to optimalize said drawing, said fluid is advantageously projected at a small angle, and even in a direction virtually parallel to the axis of the die. In fact, said small angle is often imposed by the construction of the device for carrying out the process of the invention; i.e. the arrangement of the die/fluid projection device assembly.

Furthermore, the estimation of said angle with precision, particularly in the hypothesis of the projection of a gas, is delicate in view of the turbulence prevailing at the level of said projection.

In order to obtain mixtures of fibers rich in microfibers, Applicants have sought to optimalize the conditions of carrying out the process of the invention.

When disintegration is effected with a liquid, said liquid is advantageously projected at a speed $V_1$ at least 3 times greater than the speed of extrusion $V_0$ of the cellulosic solution. More advantageously still, said speed $V_1$ of said liquid is at least 40 times greater than said speed $V_0$.

When disintegration is effected with a gas, said gas is advantageously projected at a speed $V_1$ at least 40 times greater than the speed of extrusion $V_0$ of the cellulosic solution. More advantageously still, said speed $V_1$ of said gas is at least 1000, and even 10000 times greater than said speed $V_0$ of the solution.

Concerning said speeds $V_1$ and $V_0$, respectively speed of the disintegration fluid and speed of the cellulosic solution, they may be communicated to said fluid and solution by any appropriate means.

The cellulosic solution is accelerated, for example by pumping.

The disintegration fluid, when it is question of a liquid, may flow under the action of its own weight (by gravity). It is advantageously pressurized upstream of the die. It is not excluded from the scope of the invention to communicate its speed thereto by aspiration downstream of said die by any known means and in particular by means of a suction or venturi device. In this hypothesis, the flow of the disintegration liquid which brings about cellulosic dispersion is canalized in a tube. Aspiration, downstream, is effected by means of a second liquid. This latter advantageously intervenes in the process of regeneration or precipitation of the cellulose to coagulate the particles of said dispersion. We will come back to the possible intervention of a second liquid and more generally of a second fluid, called secondary fluid, hereinbelow in the present text.

The disintegration fluid, when it is question of a gas, is generally pressurized upstream of the die. However, it is not excluded to communicate its speed thereto by aspiration downstream.

The disintegration fluid, whether it be question of a gas or a liquid, may be accelerated both by pressurization upstream of the die and by aspiration downstream thereof.

Generally, the process of the invention is carried out with the die disposed along a vertical axis. However, particularly when a gaseous disintegration and drawing fluid is employed, and when it is desired to optimalize said drawing, said die is advantageously inclined so that its axis makes with the surface of the regeneration or precipitation bath an angle smaller than 90 degrees. Such an inclination reduces the effects of the impact between the cellulosic particles, more or less solidified, and said surface; effects which are detrimental from the standpoint of drawing.

The cellulosic solution thus extruded, disintegrated into more or less drawn, more or less solidified particles, is received in a bath in which the cellulose is regenerated or precipitated.

Before such reception, the intervention of a second fluid, liquid or gaseous, may be provided within the framework of the process of the invention. Said fluid may be qualified as secondary fluid with reference to the disintegration (and drawing) fluid, in that case qualified as primary fluid. Said secondary fluid is obviously projected downstream of the primary fluid, in the flux of said primary fluid laden with cellulosic particles. It is adapted to regenerate or precipitate the cellulose at least partially. It coagulates the dispersion generated at the disintegration step.

The intervention of such a secondary fluid is all the more advantageous as the particles of the dispersion generated at the disintegration step are less rigidified. By giving said particles greater rigidity upstream of the regeneration or precipitation bath, the detrimental, from the drawing standpoint, effects of the impact between said particles and the surface of said bath, are minimized.

Within the framework of a preferred variant of the process of the invention, the intervention is recommended of a neutral primary fluid and that of a regenerating or precipitating secondary fluid (adapted to regenerate or precipitate at least partially the cellulose of the disintegrated particles; the regeneration or precipitation of said cellulose being continued and finished in the bath where said particles drop). Within the framework of this variant, the cellulosic solution is disintegrated and the particles resulting from disintegration are drawn under the action of the primary fluid; said particles being thereafter only coagulated under the action of the secondary fluid.

Advantageously, a gaseous secondary fluid is projected downstream of a gaseous primary fluid, a liquid secondary fluid downstream of a gaseous, even liquid primary fluid . . . A suction or venturi device may make it possible in each of these cases to canalize the fluids and to promote exchanges.

In the hypothesis of the primary fluid being accelerated by aspiration, the secondary fluid advantageously intervenes at the level of the means employed for creating said aspiration.

The intervention of such a secondary fluid may allow optimalization of the process of the invention with a view to producing microfibers. However, it is in no way compulsory for obtaining the expected result, i.e. the production of mixtures of fibers and microfibers; said microfibers presenting a diameter smaller than 10 $\mu$m (which corresponds approximately to a fineness lower than 1 dtex) or even smaller than 5 $\mu$m (which corresponds approximately to a fineness lower than 0.3 dtex).

At the outcome of the process of the invention, a mixture of cellulosic fibers and microfibers, more or less bonded, is recovered in the cellulose regeneration or precipitation bath. The degree of bond obviously depends on the rate of regeneration or precipitation employed upstream of said bath. If said rate is relatively consequent, relatively individualized fibers are recovered. If said rate is zero or very low, gel sticks drop into said bath which, naturally, agglutinate . . . In the absence of regeneration or precipitation upstream of said bath, a self-bonded mixture is therefore recovered.

Said more or less bonded mixture therefore characteristically contains cellulosic microfibers. The content of said microfibers in said mixture obviously depends on the conditions of carrying out the process.

Mixtures have been obtained according to the invention, which contain more than 20% in number, and even more than 40% in number of microfibers whose fineness is lower than 0.3 dtex.

Such mixtures present a very strong hydrophilic character which may be assessed by measuring their water retention. This parameter and its method of measurement are specified hereinafter.

The power of water retention or the retention of said mixtures of cellulosic fibers (mixtures including microfibers)—which increases when the microporosity increases and when the diameter of the fibers decreases—is measured under conditions similar to those of Standard DIN 53814 (according to this Standard, the sample is centrifuged at 900 gravities for 20 minutes). Applicants' test for measuring the retention parameter consists:

- in packaging a sample at 20° C. and at 65% relative humidity;
- in weighing said sample: m(g);
- in immersing it in water at 20° C.;
- in placing it on a filter, in the bowl of a centrifuge whose internal diameter is 19.5 cm (NEARV centrifuge), coated with a felt 2.5 mm thick;
- in centrifuging said bowl, at the setting of 4350 rpm (D=0.19 m) or at 2000 gravities for 3 minutes (1 min increase in speed+2 min. at 2000 gravities); the braking time then being 20 seconds;
- in weighing said centrifuged sample: M(g);
- in calculating its retention, in percentage, by the formula:

$$R(\%)=100\times(M-m)/m$$

According to the invention, mixtures of fibers have been obtained which present a water retention nearly double that of mixtures of fibers (viscose or lyocell) obtained according to the prior art.

In any case, it may be specified here that the results obtained with the process of the invention are relatively unexpected. For example, in particular from a cellulosic jet of 600 $\mu$m diameter, microfibers with a diameter smaller than or equal to 5 $\mu$m have been obtained. From such a jet and its disintegration, the formation of grains of cellulose resulting from the solidification of the droplets of the jet might, a priori, be expected . . . The extent of the drawing effected is therefore somewhat unexpected. (Conventional spinning, without mechanical drawing, of a jet of cellulosic solution with a diameter of 600 $\mu$m leads to a yarn of about one hundred microns in diameter).

The fibers and microfibers of the mixtures obtained according to the invention present variable lengths, between 1 and more than 100 mm. Generally, their length is included between 2–3 mm and 50–60 mm. Characteristically, by carrying out the process of the invention, relatively short fibers are prepared.

Said fibers may be recovered from the mixtures of fibers and microfibers obtained in the regeneration or precipitation bath, by appropriate means (assuming that the self-bonding employed was inconsequent and even non-existent), or a nonwoven nap or web may be directly obtained. To that end, a cloth for recovering the fibers will advantageously have been provided in the bath. On said cloth, a mattress of fibers is then constituted which may be conventionally bonded. Such direct obtaining of nonwoven nap or web within the framework of the invention is particularly interesting, as the man skilled in the art is not unaware of the difficulties encountered when employing microfibers by the conventional carding means.

The mixtures of fibers and microfibers of the invention may be used in the preparation of nonwoven fabrics, absorbent products, filters . . .

The process of the invention, in accordance with one or the other of its variants, advantageously includes:

- the disintegration of a solution of cellulose in N-methyl N-oxide morpholine (MMNO) with water or nitrogen; or the disintegration of a solution of viscose with water.

In order, within the framework of the above variants, to effect a partial regeneration or precipitation of the cellulose, hot air or nitrogen or slightly acidulated water is projected.

According to a particularly preferred variant, the process of the invention includes the disintegration of a solution of cellulose in N-methyl N-oxide morpholine (MMNO) with nitrogen.

The arrangement of devices suitable for carrying out the different variants of the process of the invention, is within the scope of the man skilled in the art.

The invention is illustrated in the accompanying Figures and by the following Examples.

FIGS. 1 to 3 accompany the present description, in which:

Figure 1:
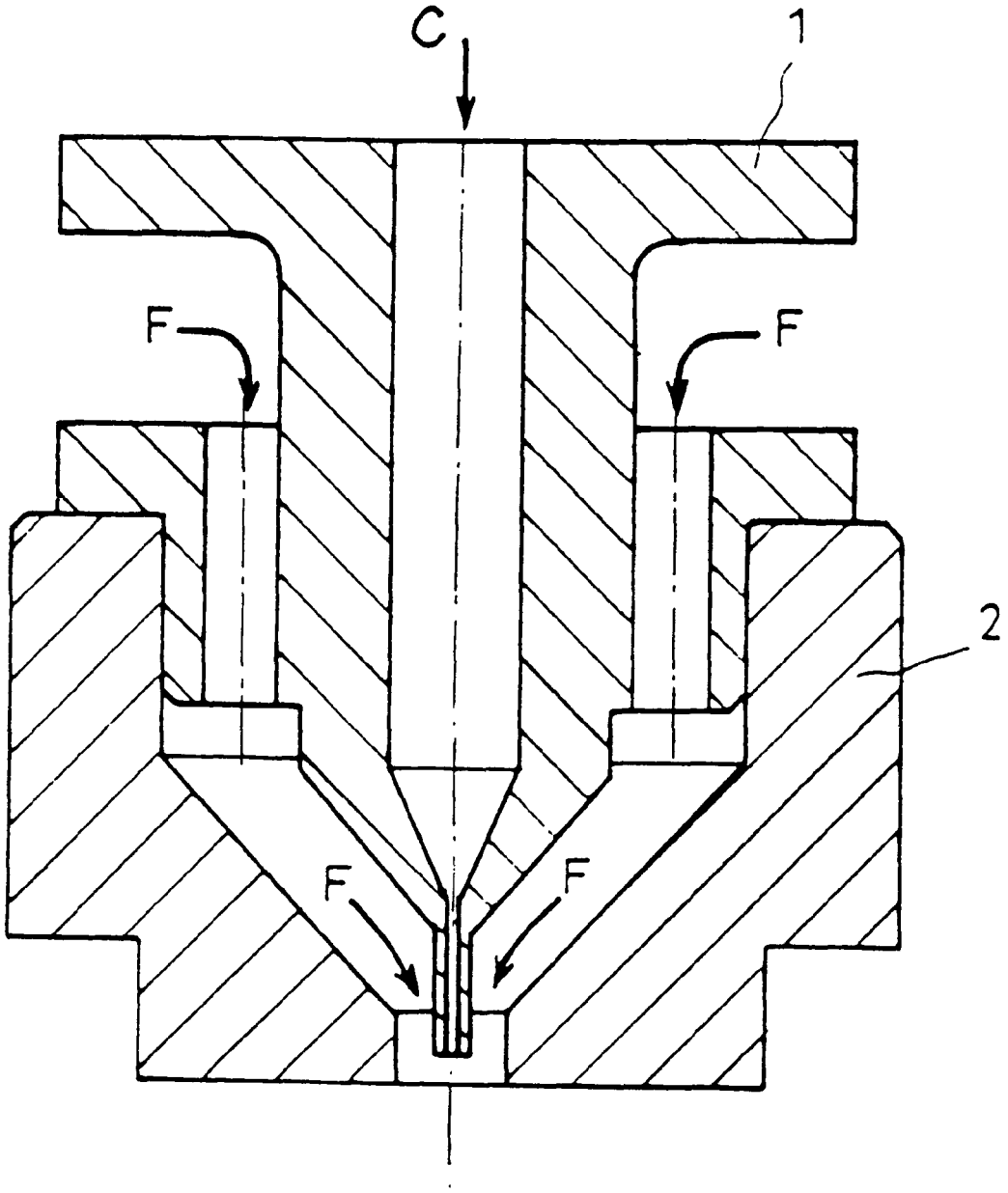
FIG. 1 shows a device within which the process of the invention may be carried out.

The device shown in FIG. 1 may be qualified as a spinning-blowing device. It is constituted by a die (or central capillary) 1 positioned on a "cap" 2. Said die 1 comprises a hole. It is supplied with cellulosic solution C. The speed of said cellulosic solution C, on leaving said die 1, is $V_0$.

The die 1/cap 2 device comprises recesses for the flow and projection of the disintegration fluid F. In fact, said fluid F circulates in a ring. It is projected at speed $V_1$ (speed on leaving the cap 2). By way of illustration, it is specified that such a device may be dimensioned as follows:

| | internal diameter | external diameter |
|---|---|---|
| Die 1 | 600 μm<br>300 μm | 900 μm<br>600 μm |
| | | diameter |
| Outlet orifice of cap 2 | | 1.5 or 1.2 mm |

Figure 2:
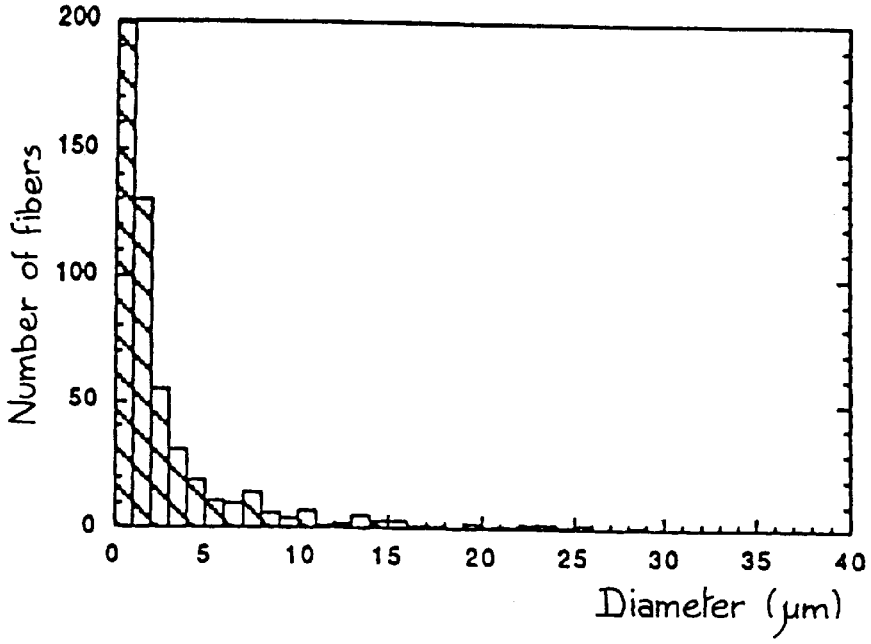
FIG. 2 is a graph indicating the distribution of the diameter of the cellulosic fibers and microfibers obtained according to the invention, by extrusion (spining) and disintegration with draw, of a cellulosic solution in MMNO; such disintegration being carried out with air (cf. Example 2e hereinafter).
Figure 3:
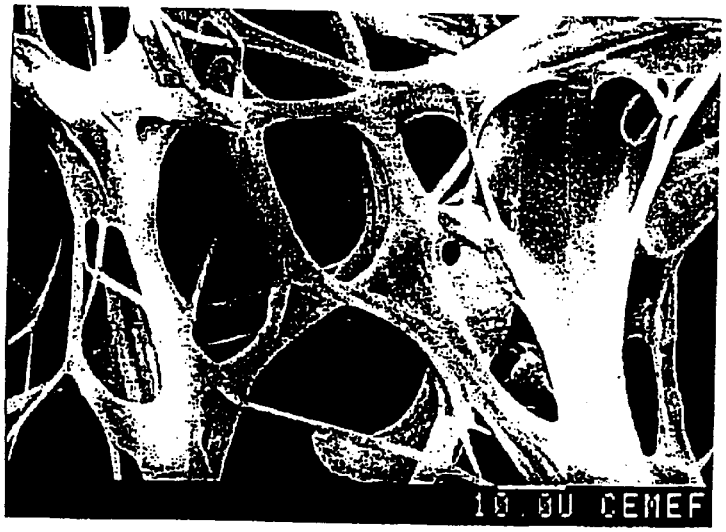
FIG. 3 is a photo taken with a scanning electron microscope (×1000 about) of a mattress of fibers and microfibers obtained according to the invention under the conditions hereinabove (cf. Example 2e hereinafter).

FIG. 2 clearly shows that mixtures of fibers rich in microfibers may be obtained according to the invention. FIG. 3 clearly shows the phenomenon of self-bonding.

The invention is illustrated by the following Examples.

The fibrous mixtures obtained were characterized by their water retention (which makes it possible to assess their hydrophilicity) and by the distribution of the diameters of the fibers constituting them.

Said fiber diameters are measured by video-microscopy or scanning electron microscopy.

Their water retention is measured under the conditions specified hereinabove (conditions similar to those of Standard DIN 53814).

EXAMPLE 1

Spinning/Disintegration of Viscose with Air

The spun solution is viscose with a viscosity of 36 poises at 25° C. (Brookfield RVT viscosity, needle No. 3, speed 10 at 18° C.) containing 7.1% by weight of cellulose, of density 1.085. The solution is pumped then spun through the spinning-blowing system described previously and shown in FIG. 1. Spinning-blowing is effected at ambient temperature.

The die used has an internal diameter of 600 μm. The flowrate of viscose through said die is 21 g/min. The speed attained by the viscose is $V_0$=1.1 m/sec.

The disintegration fluid—primary fluid—is air. It is blown through a ring with an external diameter of 1.5 mm and internal diameter of 0.9 mm. The angle of the fluid F (here, air) with the jet of cellulosic solution C (here, viscose), at contact thereof, is virtually zero and, according to FIG. 1, of 45 degrees maximum (when the "cap" 2 is slightly unscrewed). The flowrate of air $Q_1$ of 3.3 l/min corresponds to a speed $V_1$ of 48 m/sec. The temperature of the air is the ambient temperature, viz. 25° C.

Secondary air, taken to the temperature of 105° C., is blown at an angle of about 30 degrees with respect to the jet of viscose, at a rate of 150 l/min.

The jet of viscose is disintegrated and drawn by the primary air then coagulated by the secondary hot air. The cellulose is totally regenerated then, at ambient temperature, in an acid bath for 5 min. The regeneration bath is a 25 g/l sulfuric acid solution. The fibers obtained are then rinsed with hot water.

In fact, a mixture of cellulose fibers and microfibers is characteristically obtained. The mixture obtained contains about 27% of microfibers with a diameter smaller than or equal to 5 μm.

The water-retention of the mixture of said fibers and microfibers is 110 to 120%, while that of cellulosic fibers on the market—fibers presenting diameters of between 10 and 15 μm—is from 65 to 80%.

The mixture of cellulosic fibers according to the invention is characterized by the fineness and high water-retention of its fibers.

If the same experiment is carried out without employing secondary air, less fine and less hydrophilic fibers and microfibers are obtained. Their retention is slightly greater than 80%. This shows the interest in coagulating, by the secondary fluid, the hardly formed fibers and microfibers which are still in the state of gel.

EXAMPLE 2

Spinning/Disintegration of a Solution of Cellulose in MMNO with Nitrogen

This Example illustrates a particularly preferred variant of the process of the invention.

The spun solution is a solution of cellulose with a degree of polymerization 300 at the mass concentration of 5% in MMNO. Its Newtonian viscosity at 80° C. is 3.9 Pa.s. The volumetric supply flowrate of the die with said solution is 0.7 ml/min. The speed attained by the viscose is $V_0$=0.04 m/sec.

The die used presents an internal diameter of 600 μm. The ring around the die through which the nitrogen is projected presents an internal diameter of 900 μm and an external diameter of 1500 μm. The temperature of the spinning system is maintained at 80° C. and that of the nitrogen at 90° C. in order to compensate for the decrease in temperature consecutive to the pressure-reduction of the nitrogen in the atmosphere when leaving the ring of the nozzle. The flowrate of nitrogen $Q_1$ and the pressure of nitrogen $P_1$ are variable and measured. The speed $V_1$ (m/sec) of the gas upon passage through the ring of the nozzle with surface $S_1$ of $1.13 \cdot 10^{-6}$ $m^2$, is calculated in accordance with the following approximate formula:

$$V_1 = 1.2 \times (P_1^{1/2}) . Q_1 / S_1 .$$

The cellulose precipitation bath is constituted by demineralized water at ambient temperature and the axis of the jet of solution forms with the surface of the bath an angle of 18 degrees. The fibers and microfibers obtained by disintegration of the jet of solution by the nitrogen are precipitated in the water where the MMNO solvent is dissolved. After precipitation and drying, a nap or a web of fibers and microfibers, more or less bonded together, is obtained.

The higher the speed of the jet (neutral), the greater is the turbulence. This contributes to the formation of bonds between the fibers which are bonded in the bath. The points of bonding then form veritable membranes.

The mixtures obtained contain a large proportion of microfibers of less than 5 μm diameter. The following Table indicates the proportion of fine fibers as a function of the speed $V_1$ of the disintegration jet. The minimum diameter of the fibers is of the order of 0.1 to 0.2 μm and the maximum diameter from 21 to 57 μm. The unitary fibers present a mean diameter of 1 to 5 μm. In Examples 2b to 2e, nearly half the fibers, about 45%, present a diameter of less than 2 μm.

| Example | Disinteration fluid: $N_2$ Q1 (l/min) | P1 (bars) | V1 (m/s) | $V_1/V_2$ | Mean diameter (μm) | Proportion of fibers <5 μm | <10 μm | Retention (%) |
|---|---|---|---|---|---|---|---|---|
| 2a | 7 | 1.2 | 135 | 3375 | 8.5 | 44 | 68 | 85 |
| 2b | 12.7 | 1.5 | 275 | 6875 | 3.1 | 74 | 94 | 94 |
| 2c | 14.2. | 1.7 | 330 | 8200 | 4 | 64 | 83 | 93 |
| 2d | 15.6 | 1.9 | 380 | 9525 | 2.9 | 61 | 84 | 95 |
| 2e* | 19.7 | 2.7 | 575 | 14325 | 3 | 72 | 92 | 88 |

*The results obtained within the framework of this variant embodiment of the process of the invention are, as indicated hereinabove, visualized in accompanying FIGS. 2 and 3.

Mixtures of lyocell fibers and microfibers (cellulosic fibers prepared from solutions of cellulose in MMNO) are thus obtained, which present a water retention of the order of 90%.

This figure of 90% is to be compared with that of 45%, retention of water of lyocell fibers of the prior art (obtained in conventional wet spinning with mechanical drawing) of 1.7 dtex, marketed under the Trademark TENCEL® by the firm COURTAULDS.

EXAMPLE 3

Spinning/Disintegration of Viscose with Water

The spun solution is viscose with a viscosity of 43 poises at 18° C. (Brookfield RVT viscosity, needle No. 3, speed 10 at 18° C.) containing 7.1% by weight of cellulose, of density 1.085. It is extruded through the die of Example 1 at a flowrate of 27 g/min, i.e. at a speed $V_0$ of 1.4 m/sec.

The rupture fluid is water, injected at ambient temperature, at a flowrate of 0.5 l/min. The speed of said fluid at the level of the nozzle is estimated at $V_1$=7.5 m/sec.

The fibers and microfibers obtained, still in the state of gel, are regenerated in a 40 g/l sulfuric acid bath for 10 min then washed with hot water.

Their mixture presents a high retention of about 100%. It contains 38% of fibers with a diameter smaller than 5 μm.

What is claimed is:

1. Process for the preparation of a mixture of cellulosic fibers and microfibers, comprising:

the preparation of a cellulosic solution (C);

the extrusion of said solution (C) through the hole(s) of a die (1);

the disintegration of said solution (C) when it comes out of said hole(s) by projecting a liquid or gaseous fluid (F) in a direction making an angle less than or equal to 75 degrees with the axis of said die (1); said fluid (F) being neutral or adapted to regenerate or precipitate, only partially, the cellulose;

the reception in a cellulose regeneration or precipitation bath, of the dispersion generated at the disintegration step;

the recovery of the mixture of fibers and microfibers, more or less bonded, obtained in said bath.

2. Process according to claim 1, characterized in that the hole(s) of said die (1) has/have an equivalent diameter included between 100 and 1000 μm.

3. Process according to claim 1, characterized in that, for disintegrating said solution (C) with a liquid (F), said liquid (F) is projected at a speed at least 3 times greater than the speed of extrusion of said solution (C).

4. Process according to claim 1, characterized in that, for disintegrating said solution (C) with a gas (F), said gas (F) is projected at a speed at least 40 times greater than the speed of extrusion of said solution (C).

5. Process according to claim 1, characterized in that it is carried out with a die (1) whose axis makes with the surface of the regeneration or precipitation bath, an angle smaller than 90 degrees.

6. Process according to claim 1, characterized in that it further comprises the projection of a second fluid, liquid or gaseous, adapted to regenerate or precipitate at least partially the cellulose, in order to coagulate the dispersion generated.

7. Process according to claim 1, characterized in that, in said regeneration or precipitation bath, the fibers and microfibers are recovered on a cloth, with a view to producing a nap or web of nonwoven material.

8. Process according to claim 1, characterized in that said solution consists in a solution of cellulose in N-methyl N-oxide morpholine (MMNO) or in viscose.

9. Process according to claim 1, characterized in that it includes the disintegration of a solution of viscose with water.

10. Process according to claim 1, characterized in that it includes the disintegration of a solution of cellulose in N-methyl N-oxide morpholine (MMNO) with air or nitrogen.

11. Process according to claim 2, wherein said diameter is about 500 μm.

12. Process according to claim 3, wherein said speed is at least 40 times greater than the speed of extrusion of said solution.

13. Process according to claim 4, wherein said speed is at least 1000 times greater than the speed of extrusion of said solution.

14. Process according to claim 13, wherein said speed is 10000 times greater than the speed of extrusion of said solution.

* * * * *